US005477203A

United States Patent [19]

Sawazaki et al.

[11] Patent Number: 5,477,203

[45] Date of Patent: Dec. 19, 1995

[54] IGNITION COIL ASSEMBLY FOR INTERNAL COMBUSTION ENGINE

[75] Inventors: Nobuyuki Sawazaki; Shigemi Murata; Mitsuru Koiwa; Yutaka Ohashi, all of Hyogo, Japan

[73] Assignee: Mitsubishi Denki Kabushiki Kaisha, Tokyo, Japan

[21] Appl. No.: 271,962

[22] Filed: Jul. 8, 1994

[30] Foreign Application Priority Data

Jul. 9, 1993 [JP] Japan ..... 5-170415

[51] Int. Cl.[6] ..... H01F 27/02; H01F 27/30

[52] U.S. Cl. ..... 336/92; 336/96; 336/178; 336/198

[58] Field of Search ..... 336/198, 208, 336/178, 92, 96, 210, 107

[56] References Cited

U.S. PATENT DOCUMENTS

| | | | |
|---|---|---|---|
| 4,248,201 | 2/1981 | Tsutsui et al. | 123/647 |
| 4,443,777 | 4/1984 | Koike | 336/198 |
| 4,843,362 | 6/1989 | Heritier-Best | 336/92 |
| 4,866,409 | 9/1989 | Umezaki | 336/96 |
| 4,926,152 | 5/1990 | Ito et al. | 336/92 |
| 5,117,215 | 5/1992 | Kakehashi et al. | 336/178 |
| 5,172,302 | 12/1992 | Taruya et al. | 361/386 |

FOREIGN PATENT DOCUMENTS 5-87034 4/1993 Japan .

*Primary Examiner*—Thomas J. Kozma
*Attorney, Agent, or Firm*—Sughrue, Mion, Zinn, Macpeak & Seas; Richard C. Turner; Joseph J. Buczynski

[57] ABSTRACT

An ignition coil assembly for an internal combustion engine includes a primary coil, a secondary coil, at least one bobbin, a core, a first resin member and a casing. The primary coil and said secondary coil are wound on the bobbin. The core has core elements with a gap there-between through which the primary and secondary coils are magnetically coupled to one each other. The casing accommodates the primary and secondary coils, the bobbin and the core. And the first resin member covers a part of the core elements, the part which are confronted with said secondary coil, and the first resin member is accommodated in the casing.

11 Claims, 7 Drawing Sheets

IGNITION COIL ASSEMBLY FOR INTERNAL COMBUSTION ENGINE

BACKGROUND OF THE INVENTION

This invention relates to an ignition coil assembly for an internal combustion engine.

FIG. 18 is a sectional view showing a conventional ignition coil assembly for internal combustion engines. In FIG. 18, reference numeral 1 designates; a primary coil; 2, a primary bobbin on which the primary coil 1 is wound; 3, a secondary coil; 4, a secondary bobbin on which the secondary coil 3 is wound; and *5a* and *5b*, core elements, which are formed by dividing one core into two parts each having two abutting end faces. Those core element *5a* and *5b* are abutted against each other through their abutting end faces on both sides, thus forming the original core which provides a closed magnetic circuit. More specifically, the abutting end faces of the core elements *5a* and *5b* on one side are joined, for instance, by welding, and the remaining abutting end faces on the other side are coupled through a spacer 10 to each other, thus having a predetermined gap therebetween. Further in FIG. 18, reference numeral 6 designates a connector, to which both ends of the primary coil 1 and the low-voltage-side terminal of the secondary coil 3 are connected; 7, a high voltage terminal, to which the high-voltage-side of the secondary coil; and 8, a casing, in which the primary coil 1 and the secondary coil 3 are accommodated. The casing 8 is combined with the primary bobbin 2, thus forming a container. The primary coil 1 and the secondary coil 3 are sealingly held in the container with an insulating resin 9 injected into it. In order to prevent the insulating resin 9 and the metal core 5, which are greatly different in thermal expansion coefficient from each other, from directly contacting each other, the primary bobbin 2 of resin is interposed therebetween. That is, the primary bobbin 2 thus provided prevents the insulating resin 9 from being cracked by thermal shock.

The conventional internal combustion engine ignition coil assembly thus formed operates as follows:

When the application of a primary current from a power source (not shown) to the primary coil 1 is interrupted being controlled by a power transistor unit (not shown), the magnetic flux in the core forming the closed magnetic circuit is changed, so that a high voltage is induced in the secondary coil 3. The high voltage thus induced is applied through a high voltage terminal 7 and a high voltage cable (not shown) to an ignition plug (not shown). In order to prevent the leakage of the high voltage induced in the secondary coil to other parts, the primary coil 1 and the secondary coil 3 are sealingly held and insulated from each other with the insulating resin 9.

In the internal combustion engine ignition coil assembly shown in FIG. 18, the primary and secondary coils are set in the casing, and then sealingly held and insulated from each other with the insulating resin injected thereinto. The casing has a hole in the bottom through which the core is passed through. Therefore, in order to prevent the leakage of the insulating resin through the gap between the core and the casing, the following method is employed. That is, the casing is made annular in section by fixedly bonding the primary bobbin to the casing with adhesive in such a manner that the primary bobbin defines the inside diameter of the casing, and the core is inserted into the primary bobbin thus fixed. Hence, the conventional internal combustion engine ignition coil assembly suffers from the following difficulties:

That is, it is necessary to bond the primary bobbin to the casing with adhesive, and solidification of the adhesive takes time. This means that the ignition coil assembly is low in assembling efficiency. Sometimes the adhesive flows other parts in the ignition coil assembly. If the adhesive applied is not completely solidified, then it may leak out of the ignition coil assembly.

Furthermore, in the conventional ignition coil assembly, as was described above the two core elements are abutted against each other through their abutting end faces in such a manner that the abutting end faces on one side are joined directly to each other, while the remaining abutting end faces on the other side are coupled through the spacer to each other, thus providing the predetermined gap. Hence, in manufacturing the ignition coil assembly, the two core elements are abutted against each other with the spacer and the adhesive held between the abutting end faces, and in solidifying the adhesive, and in injecting and solidifying the insulating resin, it is necessary to use a certain jig to accurately support the end portions of the two core elements on the side where the gap is provided. Therefore, troubles due to errors, for instance, in insertion of the spacer are liable to take place. Thus, the conventional ignition coil assembly is low in assembling efficiency.

Accordingly, an object of this invention is to eliminate the above-described difficulties accompanying a conventional ignition coil assembly for internal combustion engines. More specifically, an object of the invention is to provide an ignition coil assembly high in reliability for an internal combustion engine which can be assembled with high efficiency and at low cost, and to provide a method of manufacturing the ignition coil assembly.

SUMMARY OF THE INVENTION

One aspect of the present invention is to improve an internal combustion engine ignition coil assembly assembling efficiency without adversely affecting the reliability. In the ignition coil assembly, the leakage of the insulating resin between the core and the casing can be prevented although the bobbin is not bonded to the casing. In addition, the ignition coil assembly is free from the difficulty that, when the core is sealed directly with the insulating resin, cracks are formed in it, thus adversely affecting the function of the ignition coil assembly.

Another aspect of the invention is also to improve an ignition coil assembly assembling efficiency. In the ignition coil assembly, of the abutting end faces of two core elements, the ones which should be set with a predetermined gap therebetween can be accurately and positively positioned by means of a spacer.

Further aspect of the invention is also to improve an ignition coil assembly assembling efficiency. In the ignition coil assembly, two core elements are combined into one unit in advance, and therefore they can be set in the casing with ease.

Still further aspect of the invention is also to improve the assembling of an ignition coil assembly efficiency. In the ignition coil assembly, the bobbin is combined with a certain component in advance, and then set in the casing.

Still further aspect of the invention is free from the difficulty that cracks are formed in the insulating resin to lower the reliability.

Still further aspect of the invention is to improve the assembling of an ignition coil assembly efficiency. For this purpose, the resin members are provided as one unit.

According one aspect of the present invention, an ignition coil assembly for an internal combustion engine includes a primary coil, a secondary coil, at least one bobbin, a core, a first resin member and a casing. The primary coil and the secondary coil are wound on the bobbin. The core has core elements with a gap there-between through which the primary and secondary coils are magnetically coupled to one each other. The casing accommodates the primary and secondary coils, the bobbin and the core. And the first resin member is accommodated in the casing, and the first resin member covers a first part of the core elements. The first part is a surface which is confronted with the secondary coil.

According to another aspect of the invention, an ignition coil assembly, in which the first resin member has a protrusion for determining the dimension of the gap between the core elements.

According to further aspect of the invention, an ignition coil assembly, in which the first resin member includes first locking elastic parts for positioning the core elements in place.

According to still further aspect, an ignition coil assembly according the invention, in which the first resin member has second locking elastic parts for fixedly supporting the bobbin.

Still further, an ignition coil assembly according to the invention further includes a second resin member for covering a second part of the core, the second part being outside the surface of an insulating resin. The second resin member is accommodated in the casing in such a manner that the second resin member is partially exposed outside the insulating resin.

Still further, an ignition coil assembly according to the invention further includes a third resin member being in contact with the insulating resin, and covering the surface which of the core is not covered with the first resin member.

Still further, in the ignition coil assembly, the first resin member has first locking parts, and the second resin member has second locking parts which are engaged with the first locking parts.

In the internal combustion engine ignition coil assembly, the primary coil, the secondary coil, and the core are accommodated in the casing, and therefore it is unnecessary to bond the primary bobbin to the bottom of the casing. Furthermore, in the ignition coil assembly, the core is sealed directly with the insulating resin; however, during thermal cycle, no cracks are formed near the high voltage part of the secondary coil, and in the surface of the insulating resin, and in the portions of the insulating resin which are molded over the components essential in function of the ignition coil assembly.

Among the abutting end faces of two core elements, the ones which should be set with a predetermined gap therebetween are accurately positioned by inserting the protrusion of the resin member therebetween. Therefore, ignition coil assemblies uniform in performance can be manufactured readily according to the invention. Furthermore, in the method, a coil unit is formed by combining the two core members with the locking elastic parts of the resin member, or by combining the resin members which cover the two core elements, or by coupling the bobbin to a certain component, and the coil unit thus formed is set in the casing. Hence, the ignition coil assembly can be manufactured on a large scale.

BRIEF DESCRIPTION OF THE DRAWINGS

FIG. 8 is a fragmentary sectional view with the core element 5*a* sectioned along line A—A in FIG. 7.

FIG. 6 is a detail view for a description of part of a second embodiment of the invention.

DETAILED DESCRIPTION OF THE PREFERRED EMBODIMENTS

A first embodiment of this invention will be described with reference to the accompanying drawings.

Figure 1:
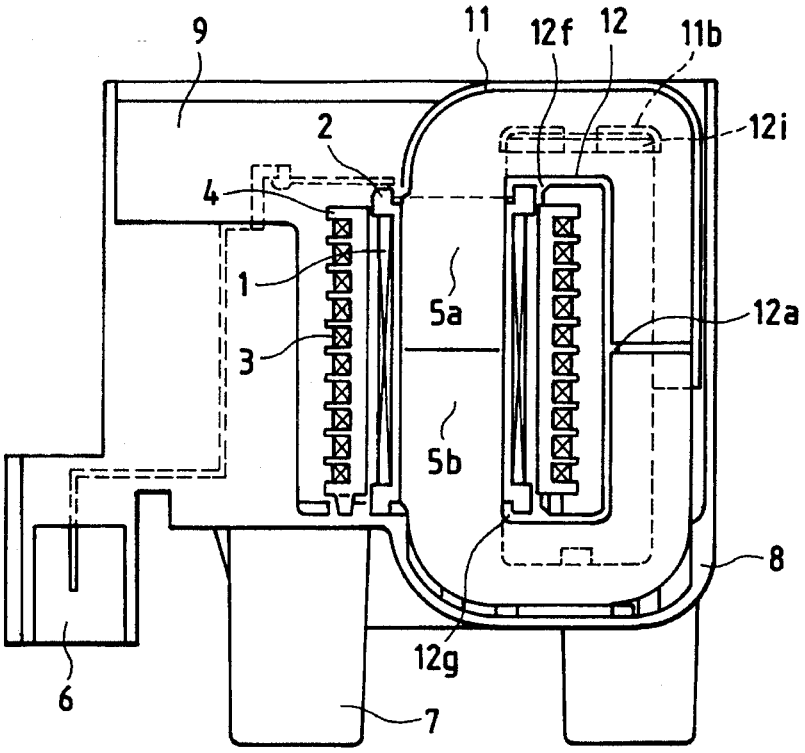
FIG. 1 is a sectional diagram of an internal combustion engine ignition coil assembly according to the present invention.
Figure 2:
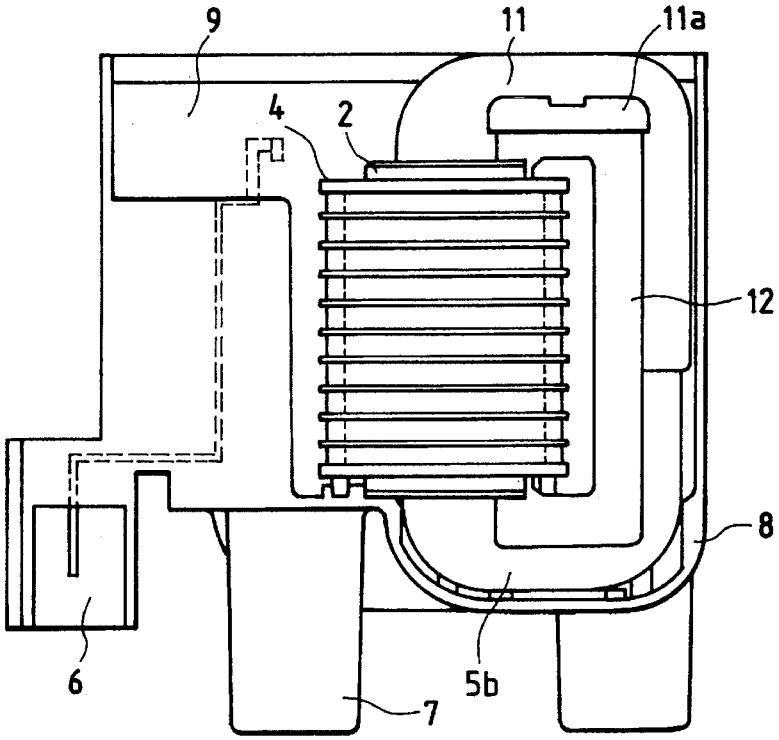
FIG. 2 is a sectional view of the ignition coil assembly shown in FIG. 1.
Figure 3:
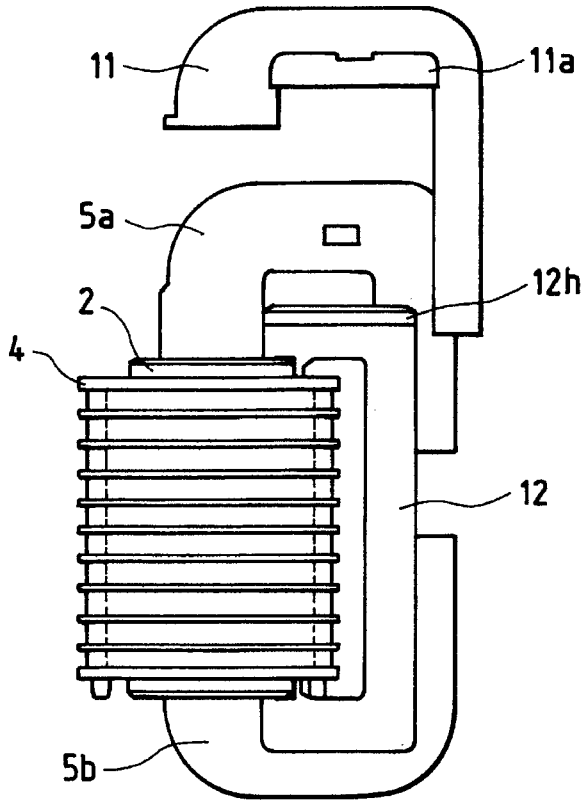
FIG. 3 is a exploded view of the ignition coil assembly shown in FIG. 1.

FIGS. 1, 2 and 3 are diagrams for a description of the first embodiment of the invention. More specifically, FIG. 1 is a sectional diagram showing essential components of the first embodiment, FIG. 2 a sectional view thereof, and FIG. 3 a fragmentary exploded view of the same.

In FIG. 1, reference numerals 1 through 9 designate the same items as those in the conventional ignition coil assembly. Further in FIG. 1, reference numeral 11 designates a resin member which is accommodated in the casing 8 in such a manner that it covers the exposed portion of the core element 5*a* which appears partially in the surface of the insulating resin 9 injected into the casing. And the resin member 11 is partially exposed outside the insulating resin 9. 11*a* (not shown in FIG. 1) and 11*b* designate locking elastic parts of the resin member 11; and 12, a resin member accommodated in the casing 8. The resin member 12 includes: a portion covering the portions of the core elements 5*a* and 5*b* which confront with the secondary coil 3; a protrusion 12*a* for providing the predetermined gap between the end faces of the core elements 5*a* and 5*b*; locking elastic parts 12*b*, 12*c*, 12*d* and 12*e* (none of them shown in FIG. 1) which position the core elements 5*a* and 5*b*; locking elastic parts 12*f* and 12*g* adapted to lock the primary bobbin 2; and locking elastic parts 12*h* (not shown) and 12*i* adapted to engage with the aforementioned resin member 11.

FIG. 2 is a sectional view corresponding to FIG. 1 with only the casing 8 and the insulating resin 9 sectioned. That is, in FIG. 2, the primary bobbin 2, the secondary bobbin 4, the core elements 5*a* and 5*b*, the resin member 11, and the resin member 12 are shown as they are (not sectioned).

FIG. 3 shows the bobbins 2 and 4, the core elements 5*a* and 5*b*, and the resin members 11 and 12 which are shown in FIG. 2 as they are (not sectioned).

Figure 4:
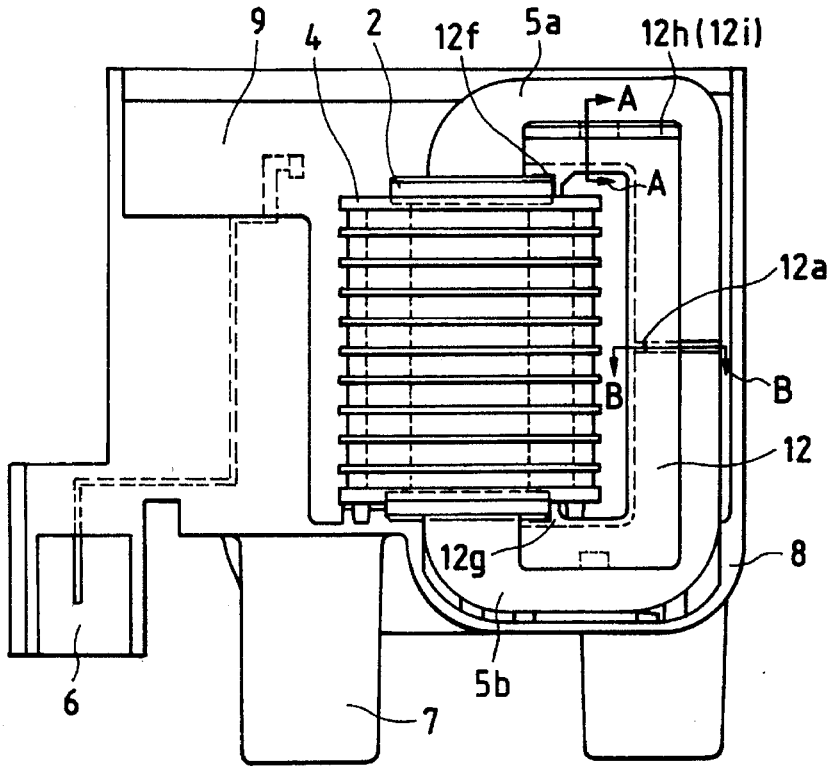
FIG. 4 is a detail view obtained by removing a resin member 11 from FIG. 2.
Figure 5:
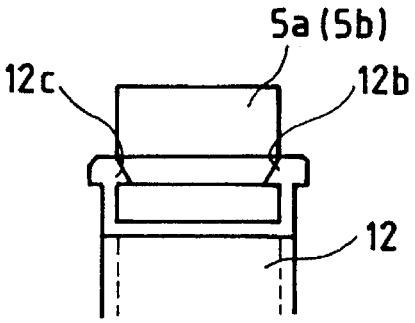
FIG. 5 is a sectional view taken along line A—A in FIG. 4.
Figure 6:
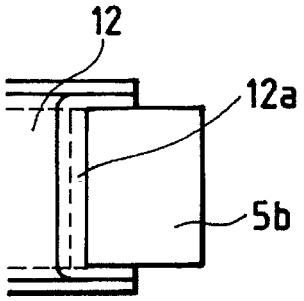
FIG. 6 is a sectional view taken along line B—B in FIG. 4.

FIGS. 4, 5 and 6 are detail views for first and second aspect of the present invention. More specifically, FIG. 4 is obtained by removing the resin member 11 from FIG. 2, and FIG. 5 is a sectional view taken along line A—A in FIG. 4, and FIG. 6 is a sectional view taken along line B—B in FIG. 4.

Figure 7:
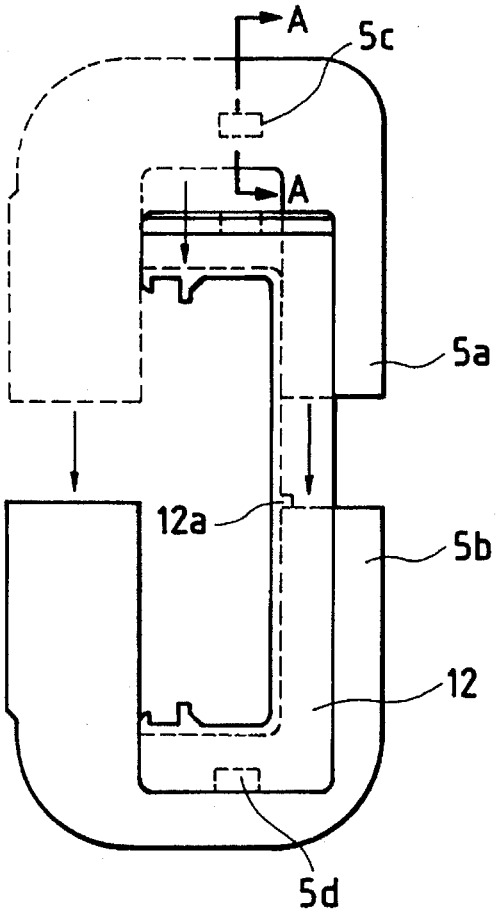
FIG. 7 is a front view for a description of the assembling of the core elements and the resin member.
Figure 8:
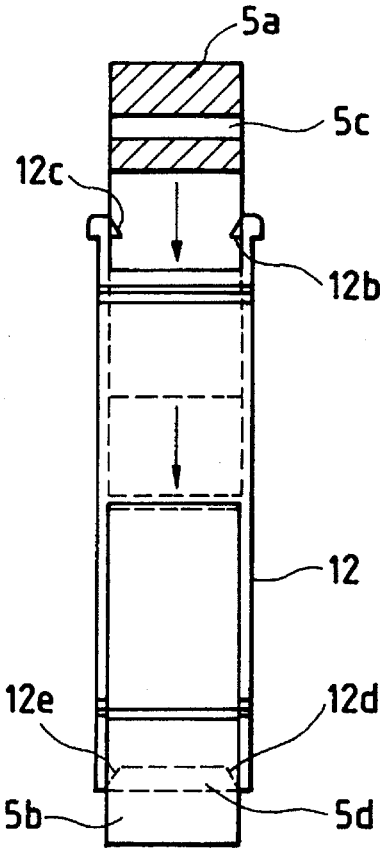
FIG. 8 is a side view of components shown in FIG. 7; more specifically.
Figure 9:
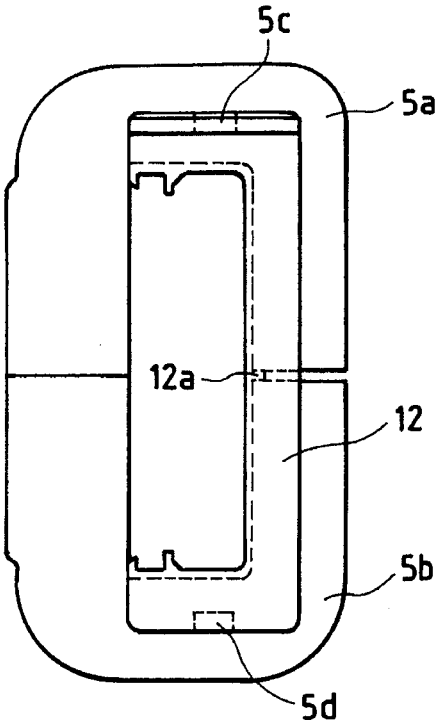
FIGS. 9 and 10 are a front view and a side view of the components of FIG. 7, respectively, which have been assembled.
Figure 10:
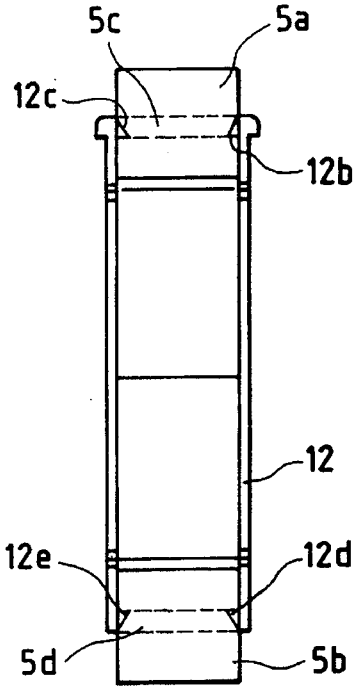

FIGS. 7 through 10 are detail views for second and third aspect of the invention. More specifically, FIG. 7 is a front view showing the assembling of the core elements 5*a* and 5*b* and the resin member 11. In FIG. 7, reference characters 5*c* and 5*d* designate through-holes formed in the core elements. FIG. 8 is a side view of components shown in FIG. 7; more specifically, FIG. 8 is a sectional view with the core element 5*a* sectioned along line A—A in FIG. 7. FIGS. 9 and 10 are a front view and a side view of the components shown in FIG. 7, respectively, which have been assembled.

Figure 11:
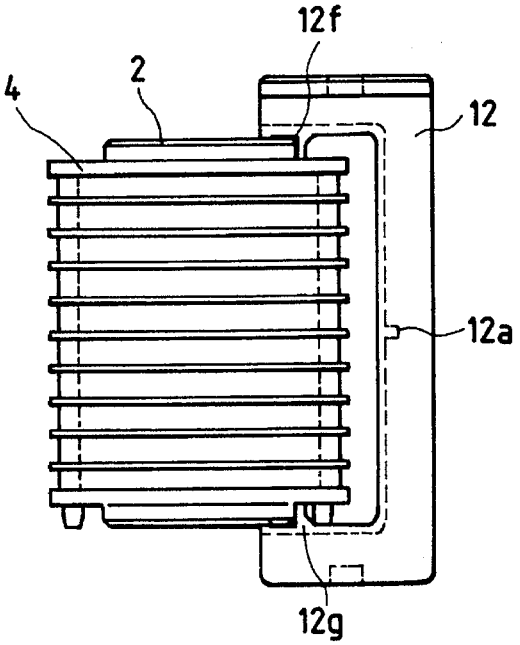
FIG. 11 is a front view showing a primary bobbin 2, a secondary bobbin 4, and a resin member 12 which have been assembled.
Figure 12:
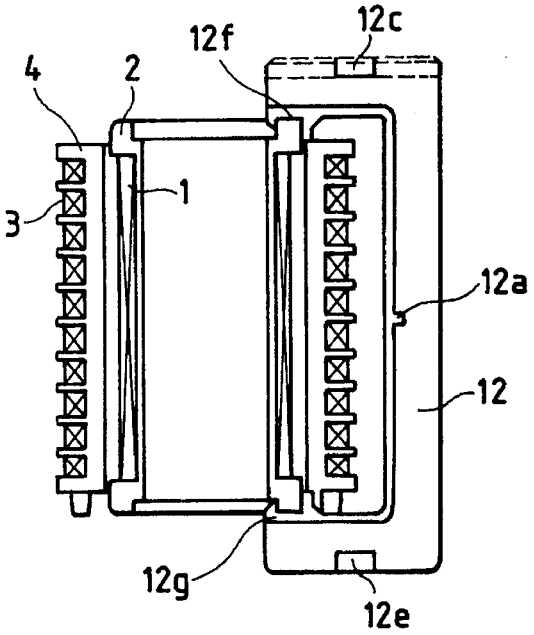
FIG. 12 is a sectional view of the primary bobbin, the secondary bobbin, and the resin member shown in FIG. 11.

FIGS. 11 and 12 are detail views for a fourth aspect of the invention. More specifically, FIGS. 11 and 12 are a front view and a sectional view, respectively, which show the assembly of the primary bobbin 2, the secondary bobbin 4, and the resin member 12.

Figure 13:
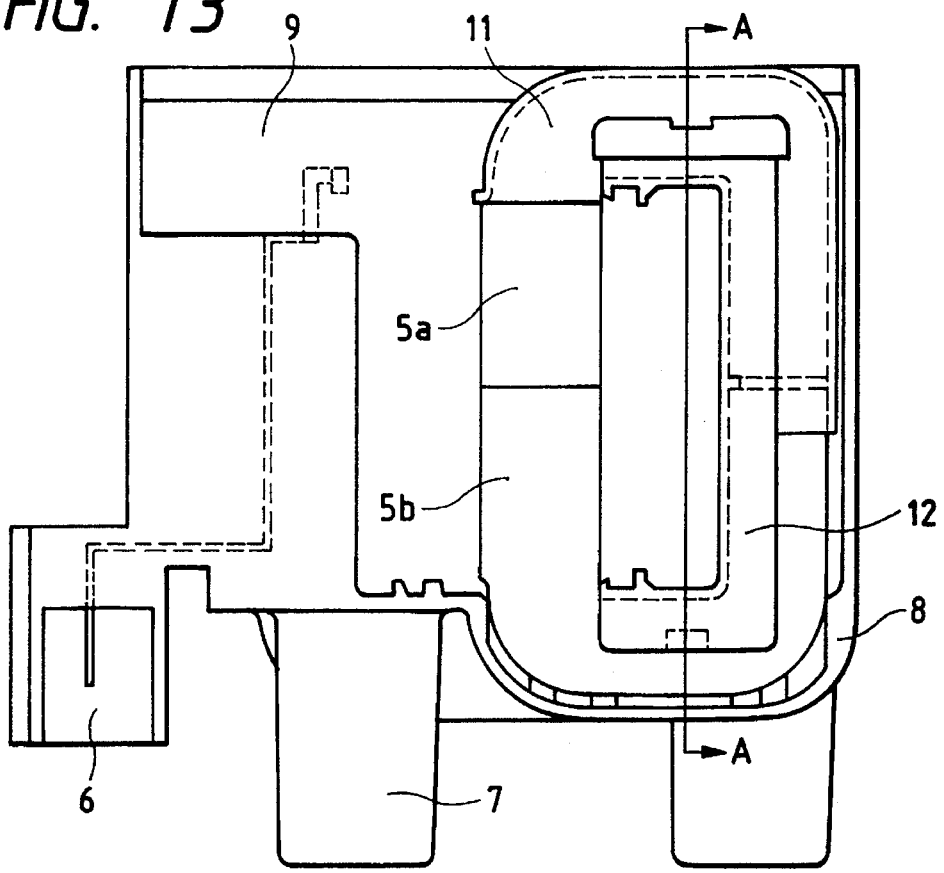
FIG. 13 is a fragmentary section view which is obtained by removing the primary bobbin 2 and the secondary bobbin 4 from FIG. 2.
Figure 14:
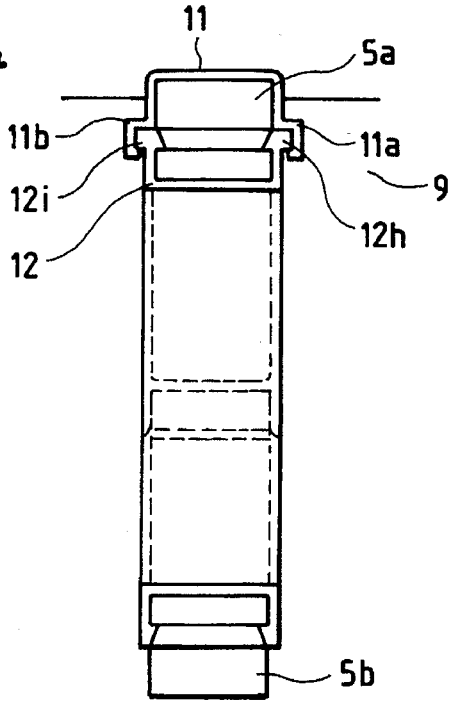
FIG. 14 is a sectional view taken along line A—A in FIG. 13.
Figure 15:
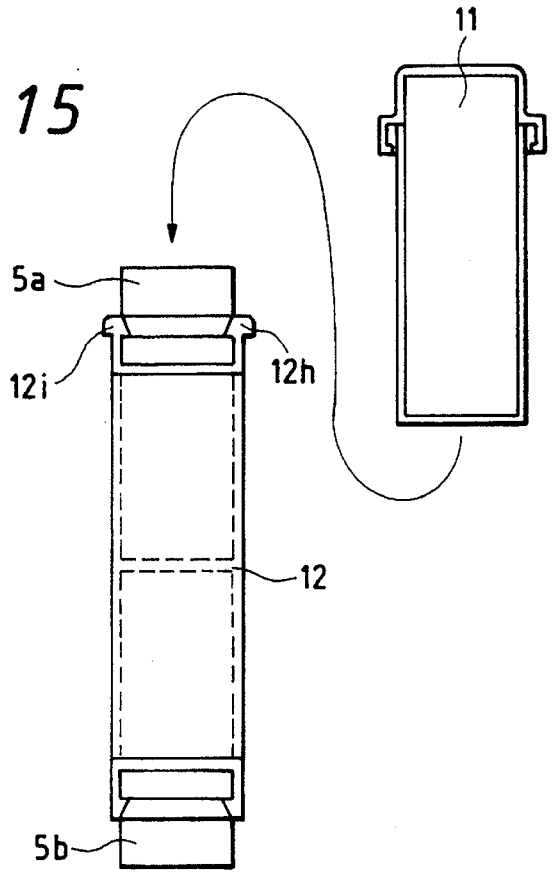
FIG. 15 is a sectional view taken along line A—A in FIG. 13, for a description of the combination of a resin member 11 with the resin member 12 which has been combined with the core elements 5*a* and 5*b*.

FIGS. 13 through 15 are detail views for fifth, sixth and seventh aspect of the invention. More specifically, FIG. 13 is a section view which is obtained by removing the primary bobbin 2 and the secondary bobbin 4 from FIG. 2, and FIG. 14 is a sectional view taken along line A—A in FIG. 13, and FIG. 15 is a sectional view taken along line A—A in FIG. 13, for a description of assembling of the resin member 11 with the core elements 5*a* and 5*b* and the resin member 12.

Figure 16:
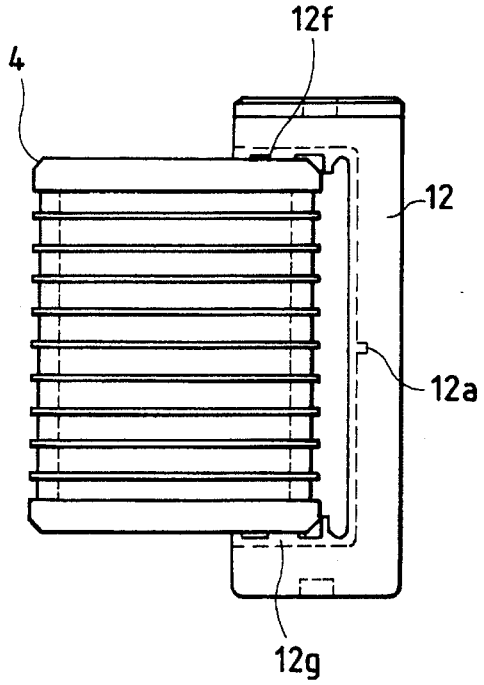
FIG. 16 is a front view showing the primary bobbin 2, the second bobbin 4, and the resin member 12 which have been assembled; more specifically.
Figure 17:
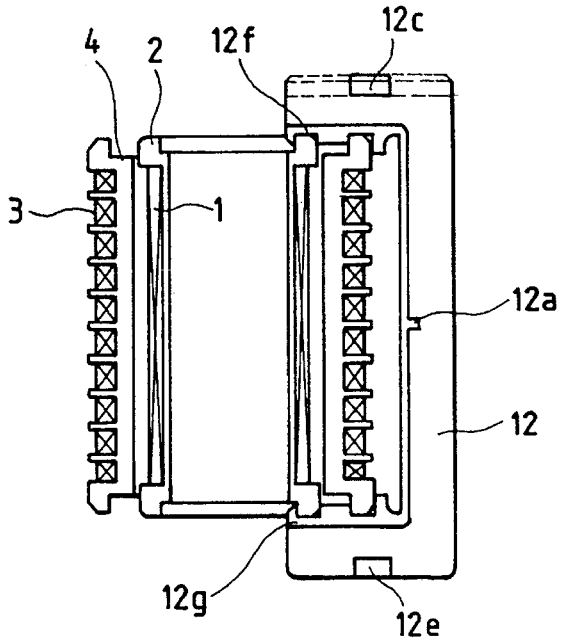
FIG. 17 is a sectional view of the primary bobbin, the secondary bobbin, and the resin member shown in FIG. 16.
Figure 18:
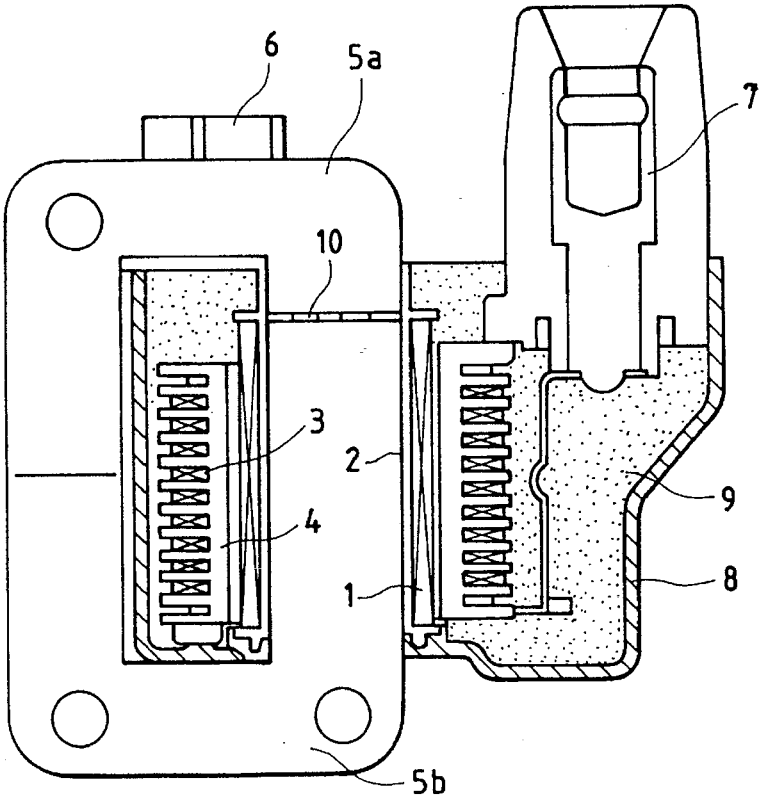
FIG. 18 PRIOR ART
FIG. 18 is a sectional view showing a conventional ignition coil assembly for internal combustion engines.

FIGS. 16 and 17 show a second embodiment of this invention.

The functions of the internal combustion engine ignition coil assembly will be described.

As shown in FIG. 4, the primary bobbin 2 and the secondary bobbin 4 on which the primary coil (not shown) and the secondary coil (not shown) have been wound, and the core elements 5*a* and 5*b* covered with the resin member 12 in such a manner that their portions confronted with the secondary coil 4 are covered with the latter 12, are set in the casing 8 and sealingly held in it with the insulating resin 9. The ignition coil assembly thus constructed is advantageous in the following points: The casing 8 has no hole in the bottom, and therefore the insulating resin 9 will never leak out. The portions of the core elements 5*a* and 5*b* which confront with the secondary coil 4 are covered with the insulating resin 9. Therefore, when the core elements 5*a* and 5*b* are directly sealingly covered with the insulating resin 9, no serious cracks are formed in the latter between the core and the high voltage part of the secondary coil.

As shown in FIGS. 4, 6, and 7 through 10, the resin member 12 set in the casing 8 has the protrusion 12*a* to provide the predetermined gap between the abutting end faces of the core elements 5*a* and 5*b*.

As shown in FIGS. 7 through 10, the core elements 5*a* and 5*b* have the through-holes 5*c* and 5*d*, respectively, which are engaged with the locking elastic parts 12*b* and 12*c* and the locking elastic parts 12*d* and 12*e* of the resin member 12, respectively, so that the core elements 5*a* and 5*b* are provided as one unit.

As shown in FIGS. 11 and 12, the primary bobbin 2 is held with the locking elastic parts 12*f* and 12*g* of the resin member 12. The resin member 12 is fixedly secured, for instance, to the core, so that the primary bobbin is positioned in place.

As shown in FIGS. 13 and 14, the portion of the core element 5*a* which is exposed outside in the insulating resin 9, and its other portions are covered with the resin member 11 which is accommodated in the casing 8 in such a manner that it is partially exposed outside the insulating resin 9; that is, the interface of the insulating resin 9 is covered with the resin member 11. Hence, when the core is directly sealed with the insulating resin, no cracks are formed in the surface of the latter which adversely affect the function of the ignition coil assembly.

As shown in FIGS. 14 and 15, the locking elastic parts 11*a* and 11*b* of the above-described resin member 11 are engaged with those 12*h* and 12*j* of the resin member 12, respectively, so that the two resin members 11 and 12 are provided as one unit. This will eliminate the difficulty that the resin member 11 floats during injection of the insulating resin 9.

In the above-described first embodiment, the primary bobbin 2 is supported with the locking elastic parts 12*f* and 12*g* of the resin member. However, the ignition coil assembly may be so designed that the locking elastic parts support the secondary bobbin 4. Alternatively, as shown in FIGS. 16 and 17, the ignition coil assembly may be so designed that both the primary bobbin 2 and the secondary bobbin 4 are supported thereby.

As was described above, in the internal combustion engine ignition coil assembly of the invention, the primary coil, the secondary coil, and the core are set in the container-like casing, the core is covered with the resin member which has the protrusion for providing the predetermined gap in the core, and all the components in the casing are combined into one unit. Hence, the ignition coil assembly is high in reliability, and can be assembled with high efficiency and at low cost.

What is claimed is:

1. An ignition coil assembly for an internal combustion engine, comprising:

a primary coil;

a secondary coil;

at least one bobbin on which said primary coil and said secondary coil are wound;

a core having first and second core elements and a gap therebetween for magnetically coupling said primary and secondary coils to each other;

a casing accommodating said primary and secondary coils, said bobbin and said core;

a first resin member accommodated in said casing, said first resin member covering a first part of each of said first and second core elements, the first part being a surface confronted with said secondary coil, said first resin member extending across said air gap and having a protrusion extending into said air gap to define the dimension of said air gap between said first and second core elements; and a second resin member for covering a second part of said first core element, the second part being outside the surface of an insulating resin, said second resin member being accommodated in said casing in such a manner that said second resin member is partially exposed outside said insulating resin.

2. An ignition coil assembly according to claim 1, wherein said first resin member includes first locking elastic means for positioning said core elements in place.

3. An ignition coil assembly according to claim 1, wherein said first resin member has second locking elastic means for fixedly supporting said bobbin.

4. An ignition coil assembly according to claim 1, wherein said second part is a surface not covered with the first resin member, and said second resin member contacts said insulating resin.

5. An ignition coil assembly according to claim 1, wherein;

said first resin member has a first locking portion, and said second resin member has a second locking portion which is engaged with said first locking portion.

6. An ignition coil assembly according to claim 1, wherein said second resin member further covers a second part of said second core element.

7. An ignition coil assembly according to claim 1, wherein said first resin member includes a first locking member having projections which engage with said at least one bobbin to hold said at least one bobbin in place.

8. An ignition coil assembly according to claim 1, wherein said at least one bobbin includes a first bobbin on which said primary coil is wound and a second bobbin on which said secondary coil is wound, said first resin member having an engaging portion which engages said first bobbin to hold said first bobbin in place.

9. An ignition coil assembly according to claim 1, wherein said protrusion is at a position substantially equidistant from the edges of said first resin member in the direction of the length of said first resin member.

10. An ignition coil assembly according to claim 1, wherein said first and second core elements each have a portion which extends within an opening in said at least one bobbin, and said air gap is outside of said at least one bobbin.

11. An ignition coil assembly according to claim 1, wherein said second resin member has an engaging portion which engages with said at least one bobbin.

* * * * *